US007862636B2

(12) United States Patent
Mun et al.

(10) Patent No.: US 7,862,636 B2
(45) Date of Patent: Jan. 4, 2011

(54) CEILING TYPE AIR CONDITIONER

(75) Inventors: Seong Kuk Mun, Changwon-si (KR); Dong Myeong Choi, Changwon-si (KR)

(73) Assignee: LG Electronics Inc., Seoul (KR)

( * ) Notice: Subject to any disclaimer, the term of this patent is extended or adjusted under 35 U.S.C. 154(b) by 226 days.

(21) Appl. No.: 12/213,461

(22) Filed: Jun. 19, 2008

(65) Prior Publication Data

US 2009/0188216 A1 Jul. 30, 2009

(30) Foreign Application Priority Data

Jan. 28, 2008 (KR) ..... 10-2008-0008656

(51) Int. Cl.
*B01D 46/00* (2006.01)

(52) U.S. Cl. ..... 55/289; 55/296

(58) Field of Classification Search ..... 55/296, 55/289, 295; 95/282
See application file for complete search history.

(56) References Cited

U.S. PATENT DOCUMENTS 6,729,154 B2 * 5/2004 Takashima et al. ..... 62/317
7,325,274 B2 * 2/2008 Jeong ..... 15/352
2005/0138759 A1 * 6/2005 Park et al. ..... 15/347

* cited by examiner

*Primary Examiner*—Duane Smith
*Assistant Examiner*—Tiffany N Palmer
(74) *Attorney, Agent, or Firm*—McKenna Long & Aldridge LLP

(57) ABSTRACT

Enclosed is an air conditioner including a foreign matter collecting unit to secondarily collect foreign matter in a brush assembly when the brush assembly for firstly collecting and accumulating the foreign matter filtered by a filter automatically moves. Therefore, the foreign matter separated from the filter is firstly collected in the brush assembly, and the foreign matter can be secondly collected in the foreign matter collecting unit by moving the brush assembly. Therefore, the foreign matter filtered by the filter is automatically removed so that the inconvenient of exchanging and cleaning the filter can be settled and pollution of the filter can be prevented. Since the foreign matter is discharged to outdoor side by simply detaching the foreign matter collecting unit so that convenience of use can be enhanced.

20 Claims, 11 Drawing Sheets

CEILING TYPE AIR CONDITIONER

This non-provisional application claims priority under 35 U.S.C. §119(a) on Patent Application No. 10-2008-0008656 filed in Republic of Korea on Jan. 28, 2008, 2008, the entire contents of which are hereby incorporated by reference.

BACKGROUND OF THE INVENTION

1. Field of the Invention

The present invention relates to a ceiling type air conditioner, and more particularly, to a ceiling type air conditioner including a foreign matter collecting unit to secondarily collect foreign matter in a brush assembly when the brush assembly for firstly collecting and accumulating the foreign matter filtered by a filter automatically moves.

2. Discussion of the Related Art

A conventional ceiling type air conditioner includes an indoor unit installed to a ceiling to perform a cooling operation, an outdoor unit to radiate heat and to perform a compression operation, and a refrigerant tube to connect the indoor unit with the outdoor unit. The indoor unit suctions indoor air to undergo heat-exchange in a case in which a heat-exchanger is disposed, and discharges the heat-exchanged air into indoor side such that a user builds a desired indoor environment.

The indoor unit performs a function of purifying indoor air other than the regulation of indoor temperature as described above. To this end, the conventional air conditioner includes a net filter disposed at an air intake hole through which air is suctioned in order to filter foreign matter contained in the air suctioned into the case.

However, according to the conventional ceiling type air conditioner, since a flow of air passing inside the indoor unit is obstructed as quantity of foreign matter collected by the filter increase, the ceiling type air conditioner is deteriorated. Since the filter must be detachably installed for the cleaning or exchange of the filter, position and way of installing the filter and layout of peripheral components must be restricted. Moreover, since a user must directly exchange or clean the filter, it is inconvenient to exchange or clean the filter, and pollution of the filter brings a bad feeling of the user.

SUMMARY OF THE INVENTION

It is an object of the present invention to provide an air conditioner including a foreign matter collecting unit to secondarily collect foreign matter in a brush assembly when the brush assembly for firstly collecting and accumulating the foreign matter filtered by a filter automatically moves.

The present invention provides a ceiling type air conditioner comprising: a case disposed on the ceiling and having a predetermined space defined therein; a base panel disposed in the case and having an air intake hole formed at a side thereof; a filter disposed at the air intake hole; a brush assembly for firstly collecting and accumulating foreign matter filtered by the filter; a suctioning unit for suctioning the foreign matter collected in the brush assembly when the suctioning unit communicates with the brush assembly; and a foreign matter collector for secondarily collecting the foreign matter suctioned by the suctioning unit.

According to the ceiling type air conditioner of the present invention, the foreign matter separated from the filter is firstly collected in the brush assembly, and the foreign matter can be secondly collected in the foreign matter collecting unit by moving the brush assembly. Therefore, the foreign matter filtered by the filter is automatically removed so that the inconvenient of exchanging and cleaning the filter can be settled and pollution of the filter can be prevented. Since the foreign matter is discharged to outdoor side by simply detaching the foreign matter collecting unit so that convenience of use can be enhanced.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Hereinafter, a ceiling type air conditioner according to embodiments of the present invention will be described with reference to the accompanying drawing in detail.

Figure 1:
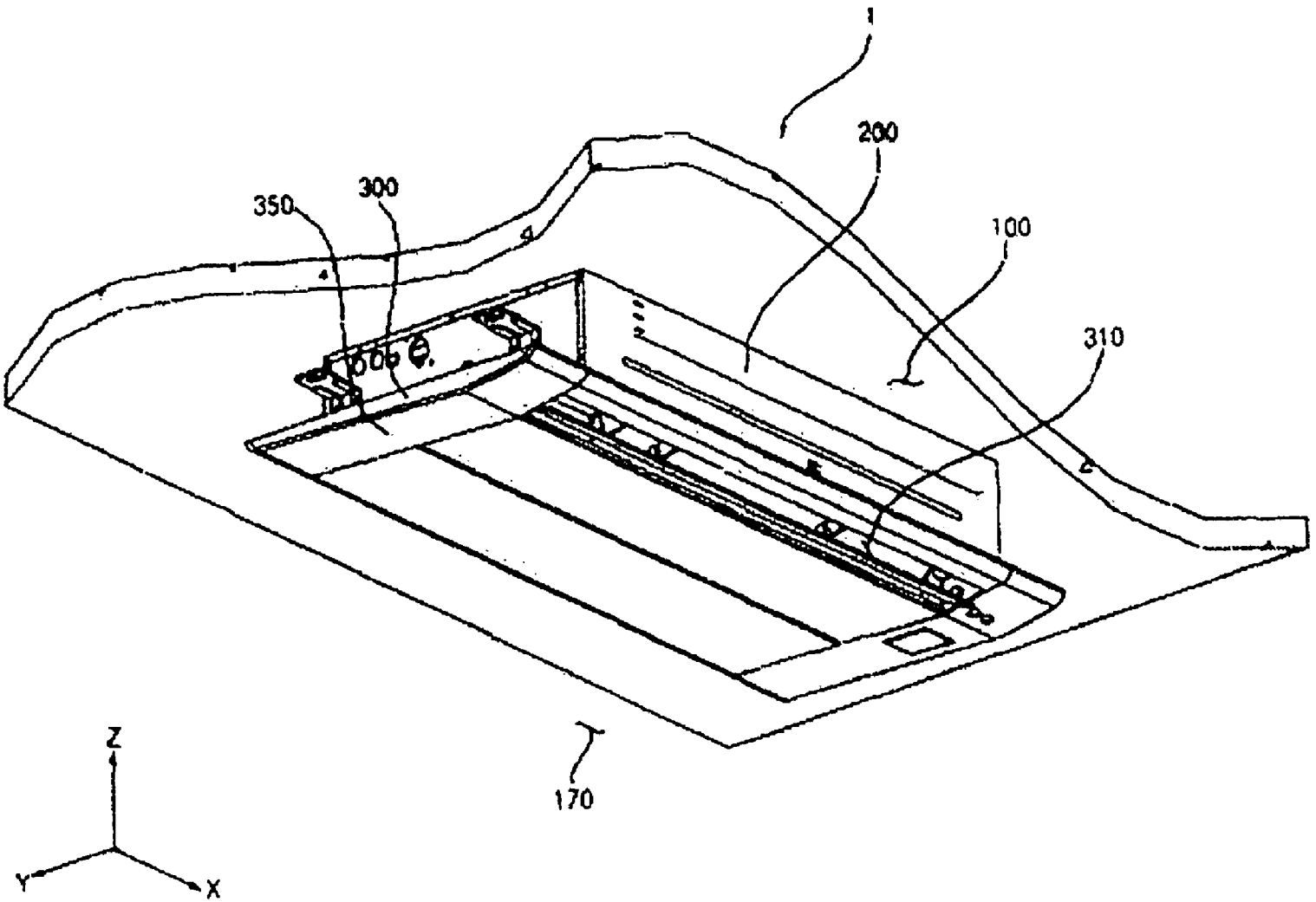
FIG. 1 is a perspective view illustrating an appearance of a ceiling type air conditioner according to an embodiment of the present invention.
Figure 2:
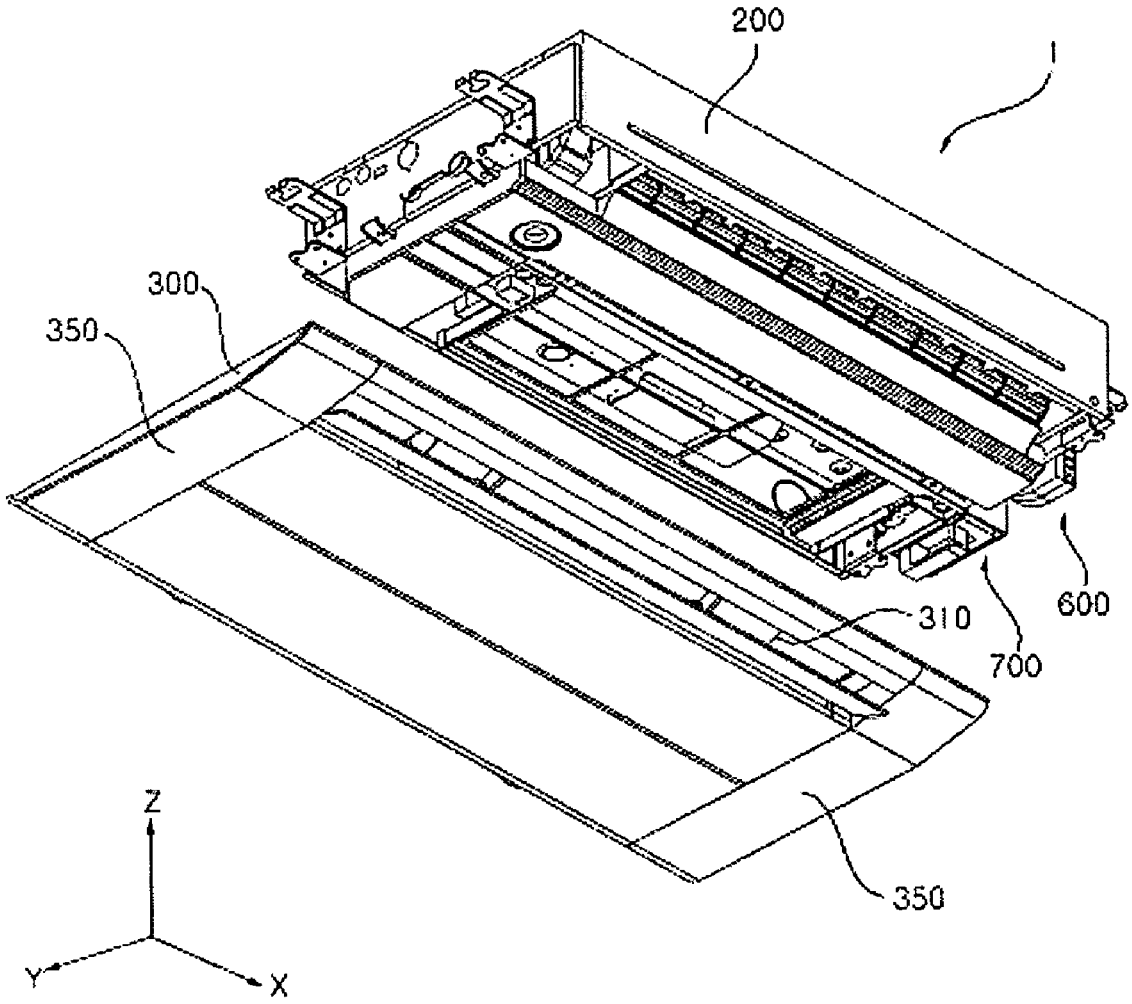
FIG. 2 is an exploded perspective view illustrating a base panel separated from a case in FIG. 1.

FIG. 1 is a perspective view illustrating an appearance of a ceiling type air conditioner 1 according to an embodiment of the present invention, and FIG. 2 is an exploded perspective view illustrating a base panel 300 separated from a case 200 depicted in FIG. 1.

Referring to FIGS. 1 and 2, the ceiling type air conditioner 1 includes the case 200 fixed in the interior space of ceiling 100 to suction air and to discharge heat-exchanged air. The case 200 has a rectangular parallelepiped shape with an opened bottom and longitudinal sides longer than other sides. The case 200 may be fixed to closely contact the upper side of the interior space of the ceiling 100 by means of a fastening tool such as a bolt (not shown).

Hereinafter, for convenience sake, in FIGS. 1 and 2, the longitudinal direction, that is, the right-to-left direction of the case 200 is denoted by reference numeral X, a direction horizontally orthogonal to the longitudinal direction of the case 200, that is, a front-to-rear direction is denoted by reference numeral Y, and a direction orthogonal to the longitudinal direction of the case 200, that is, an up-to-down direction is denoted by reference numeral Z.

In the case 200, there are arranged various heat-exchanging components 180 for suctioning air from an indoor side 170 to perform heat exchange and for discharging the heat-exchanged air.

The ceiling type air conditioner 1 further includes a base panel 300 coupled with the lower side of the case 200 to cover the opened bottom of the case 200.

Figure 3:
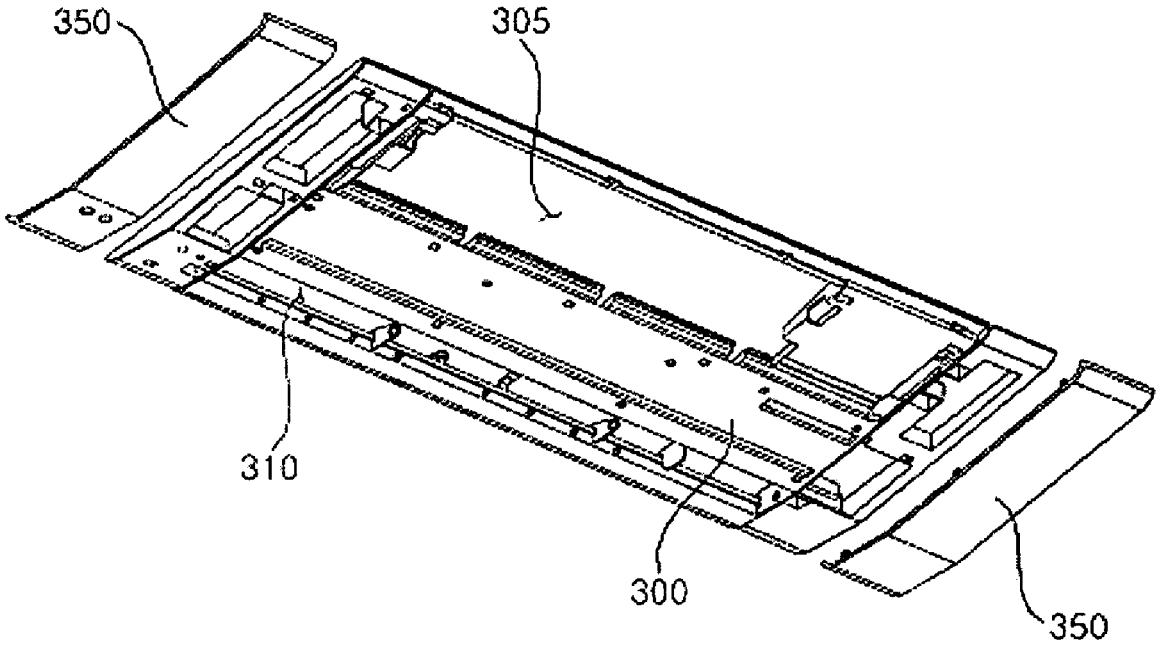
FIG. 3 is an exploded perspective view illustrating principal components disposed on the base panel in FIG. 1.
Figure 4:
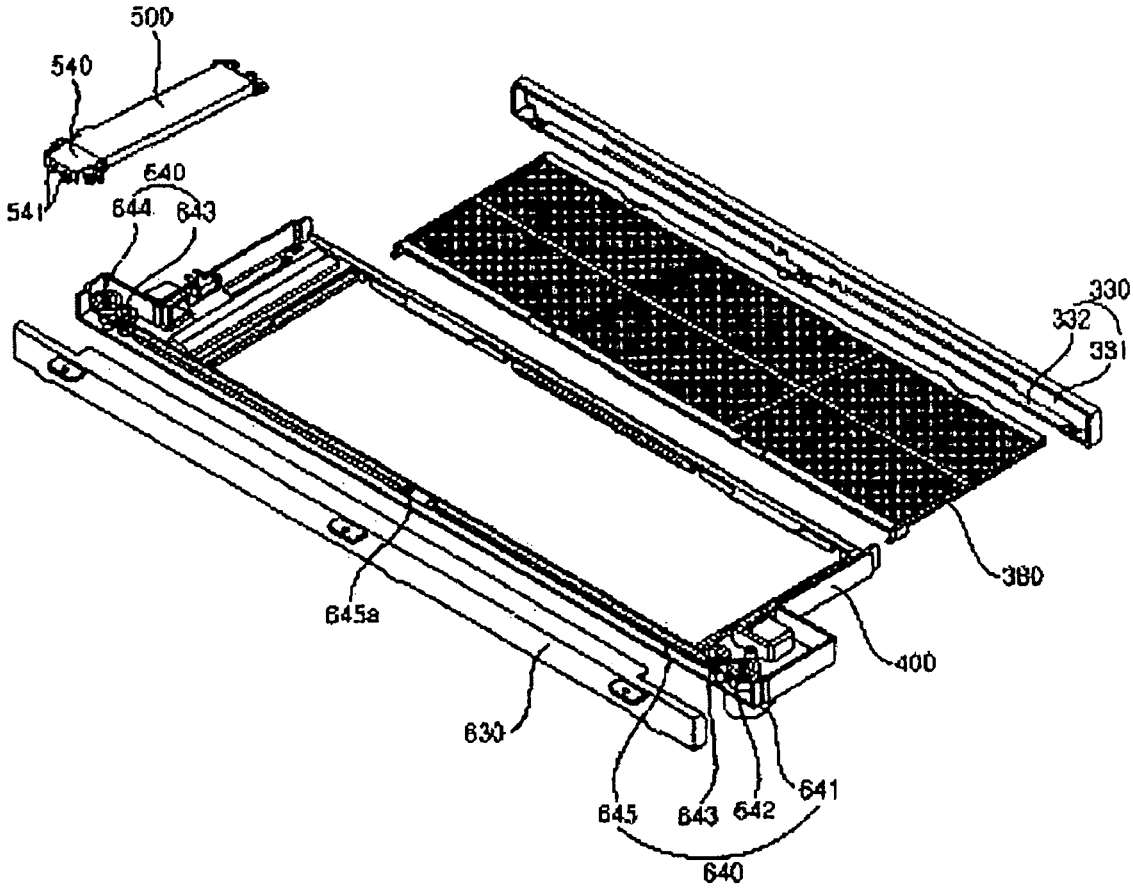
FIG. 4 is a perspective view illustrating a filter disposed at an air intake hole in FIG. 3 and a brush assembly for separating foreign matter filtered by the filter while moving along the filter.
Figure 5:
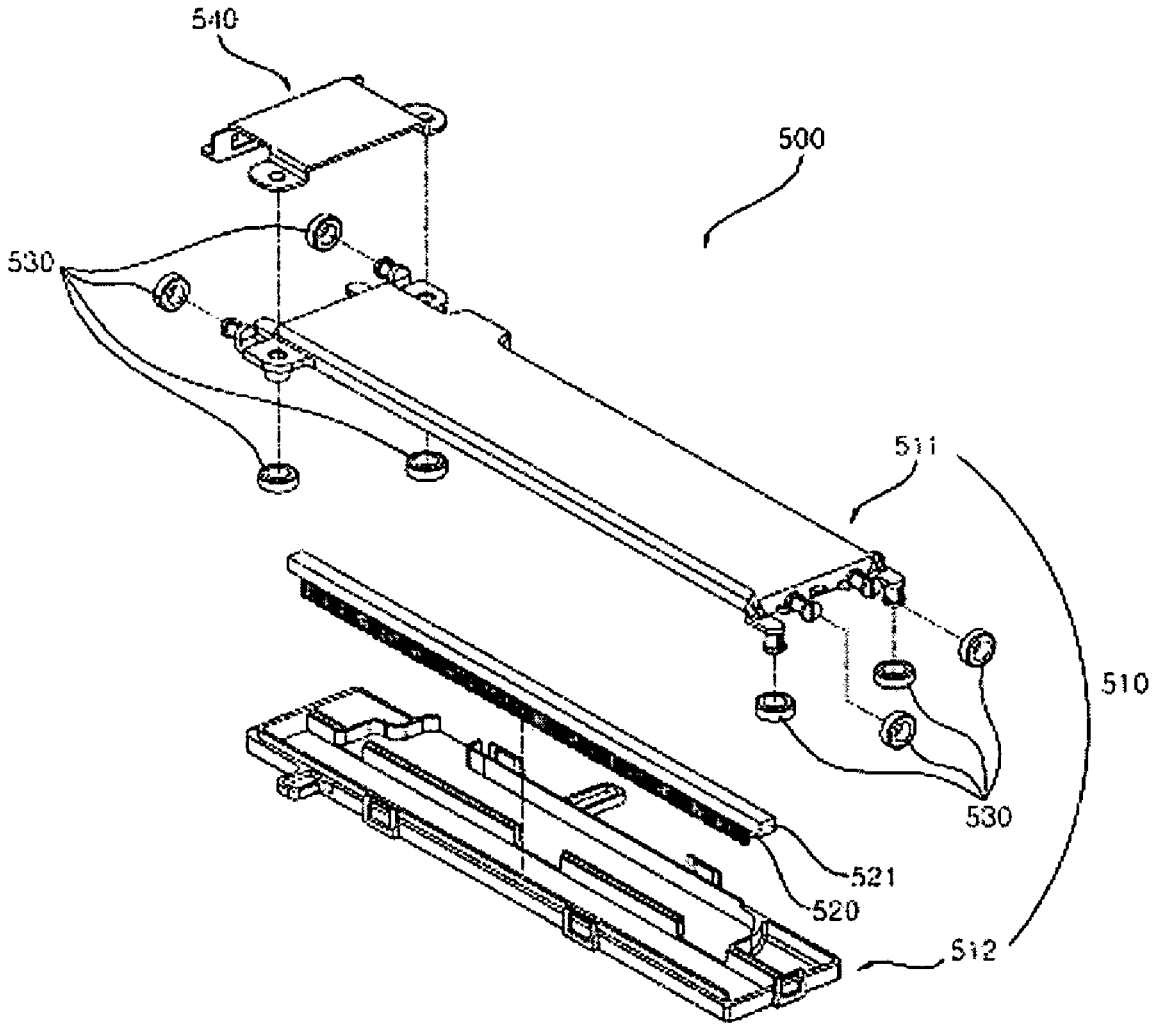
FIG. 5 is an explode perspective view illustrating the brush assembly in FIG. 4.

FIG. 3 is an exploded perspective view illustrating principal components disposed on the base panel 300 in FIG. 1, and FIG. 4 is a perspective view illustrating a filter 380 disposed at an air intake hole 305 in FIG. 3 and a brush assembly 500 for separating foreign matter filtered by the filter 380 while moving along the filter 380. FIG. 5 is an explode perspective view illustrating the brush assembly 500 in FIG. 4.

Referring to FIG. 3, the base panel 300 is formed with the air intake hole 305 through which air is suctioned, and an air discharge hole 310 through which the air is discharged. The air intake hole 305 and the air discharge hole 310 are formed long in the X-direction to be parallel to each other while being spaced apart from each other in the Y-direction on the base panel 300 to communicate the inside with the outside of the case 200. An air intake plane of the air intake hole 305 and an air discharge plane of the air discharge hole 310 may be substantially arranged in the parallel relationship with respect to the horizontal plane.

To the lower side of the base panel 300 corresponding to at least one of right and left sides of the base panel 300, a side panel 350 is attached. The side panel 350 is disposed in the lower side of the base panel 300 to form some of the appearance of the air conditioner 1.

The filter 380 is disposed in the air intake hole 305 to filter foreign matter contained in the suctioning air. The filter 380, as shown in FIG. 4, may be seated on a filter housing 400 disposed in the air intake hole 305. The filter 380 detachably attached to the filter housing 400 such that the filter 380 can be detached from the filter housing 400 by a user. Although the filter 380 is attached to and detached from the filter housing 400 by being fitted into or sliding into the filter housing 400, the coupling way of the filter and the filter housing is not limited to this.

Referring to FIG. 5, the brush assembly 500 includes a brush 520 and a main body 510. The brush 520 contacts foreign matters filtered by the filter 380. The main body 510 contacts the brush 520 to form a predetermined space in which the foreign matters that drop from the filter 380 in a gravitational direction are collected and stored. Therefore The main body 510 forms a certain space sufficient to firstly collecting and accumulating foreign matter contacting and separated from the filter 380. The main body 510 includes a main base 511 for forming the bottom of the main body and a main lid 512 for covering the main base 511.

The main base 511 includes at least one support protruding from the bottom thereof and a brush frame 521 is coupled on the support.

The brush 520 is fixed to the brush frame 521 provided in the main body 510. The brush 520 is disposed in the lower side of the filter 380 to contact the foreign matter filtered by the filter 380 and to make the foreign matter drop down in the gravitational direction. The foreign matter filtered by the filter 380 drops in the gravitational direction due to the contact between the brush 520 and the filter 380 and is accumulated in the main base 511.

In the filter housing 400, the brush assembly 500 is disposed to move along the filter 380. The brush assembly 500 is moved along the filter 380 by a moving unit 640. Referring to FIG. 5, the brush assembly 500 further includes a plurality of rollers 530 disposed between the filter housing 400 and the main body 510. When the brush assembly 500 is moved by the moving unit 640, the rollers 530 roll along a side of the filter housing 400 and due to the rolling of the rollers the brush assembly 500 moves.

Referring to FIG. 4, the filter housing 400 further includes a movement guiding unit 330 formed at least one side of the filter housing 400 to support sides of the main body 510 so as to guide the movement of the brush assembly 500 and to prevent the main body 510 from being detached down from the brush assembly 500.

Referring to FIGS. 4 and 5, the movement preventing unit 330 includes supporting surfaces 331 downwardly extending from sides parallel to the longitudinal direction of the filter housing 400 to support the longitudinal sides of the brush assembly 500, and a detachment prevention surface 332 extending from an end of the supporting surfaces 331 in the parallel relationship to the filter housing 400 to prevent the brush assembly 500 from being detached down.

The filter housing 400 is provided with the movement guiding unit 330 formed in at least one side thereof, or as shown in FIG. 4, in both sides thereof to support of the both sides of the brush assembly 500.

Referring to FIG. 5, the plural rollers 530 are disposed in the movement guiding unit 330 to roll. In more detail, the rollers 330 are disposed at ends of the brush assembly 500. Horizontal rollers and vertical rollers are provided in respective platforms of the brush assembly 500 such that the horizontal rollers support the brush assembly 500 not be separated in the lateral direction and the vertical rollers support the brush assembly 500 not separated in the vertical direction.

Referring to FIG. 4, the moving unit 640 is interconnected to the brush assembly 500. The moving unit 640 reciprocates the brush assembly 500 linearly to clean the filter 380 and moves the brush assembly 500 to a place through which the foreign matter accumulated in the brush assembly 500 is discharged out. In other words, the brush assembly 500 keeps reciprocating linearly along the filter housing 400 by the moving unit 640.

Therefore, when the brush assembly 500 moves in a direction of the filter housing 400 (in the X-direction of FIG. 1), the brush 520 contacts the filter 380 and the foreign matter separated from the filter 380 due to the contact drops down in the gravitational direction so that the foreign matter is firstly collected in the main body 510.

The moving unit 640 moves the brush assembly 500 in a direction of the filter housing 400 (in the X-direction of FIG. 1). In more detail, the moving unit 640 includes a driving motor 641 disposed at one of sides of the filter housing 400 and a power transmission engaged with the brush assembly 500 to transmit a driving force of the driving motor to the brush assembly 500. Therefore, the brush assembly 500 is coupled with the filter housing 400 and can be moved along a direction of the filter housing 400 by the power transmission.

The power transmission includes a driving pulley 642, a driven pulley 644, a tension pulley 643, and a wire belt 645. The driving pulley 642 is connected to a rotation shaft of the driving motor 641 and is rotated by the association of the driven pulley 642 with the rotation shaft of the driving motor 641 when the rotation shaft of the driving motor 641 rotates due to an electric power applied from a power supply. The driven pulley 644 is disposed at the other end of the filter housing 400 to which the driving pulley 642 is disposed.

When the driving force is transmitted to the wire belt 645 by the rotation of the driving pulley 642, the wire belt 645 rotates and the driven pulley 644 also rotates in association with the rotation of the wire belt 645.

The wire belt 645 is wound around the driving pulley 642 and is connected to the brush assembly 500 to transmit the driving force of the driving motor 641 to the brush assembly 500. As shown in FIGS. 4 and 5, the brush assembly 500 has a wired connector 540, formed at a side of the brush assembly 500, to which the wire belt 645 is connected. An end and the other end of the wire belt 645 are formed with rings 645*a* which are locked by an end of the wire connector 540. Preferably, the end of the wire connector 540 has a hook shape for the easy attachment and detachment of the wire belt 645. Moreover, the wire belt 645 may be made of elastic material such that a contact force between the driving pulley 642 and the tension pulley 643 or between the driven pulley 644 and the tension pulley 643 increases.

The tension pulley 643 is spaced apart from the driving pulley 642 and the driven pulley 644 on a traveling path of the wire belt 645 to generate a tensile force of the wire belt 645 by which the wire belt 645 is wound around a side of the tension pulley 643.

Meanwhile, the plural rollers 530 are disposed to the movement guiding unit 330 and roll due to the driving force transmitted from the power transmission. In other words, when the driving force of the driving motor 641 is transmitted to the wire belt 645, the wire belt 645 rotates and due to the winding of the wire belt 645 the rollers 530 of the brush assembly 500 roll along the supporting surfaces 331 and the detachment prevention surfaces 332 of the movement guiding unit 330, respectively.

As such, according to the ceiling type air conditioner 1 in accordance with the embodiment of the present invention, a user must not detach the filter 380 from the air conditioner 1 in order to clean the filter 380 through which foreign matter is filtered, and the brush assembly 500 automatically cleans the filter 380 while moving along the filter 380, resulting in improving convenience.

Figure 6:
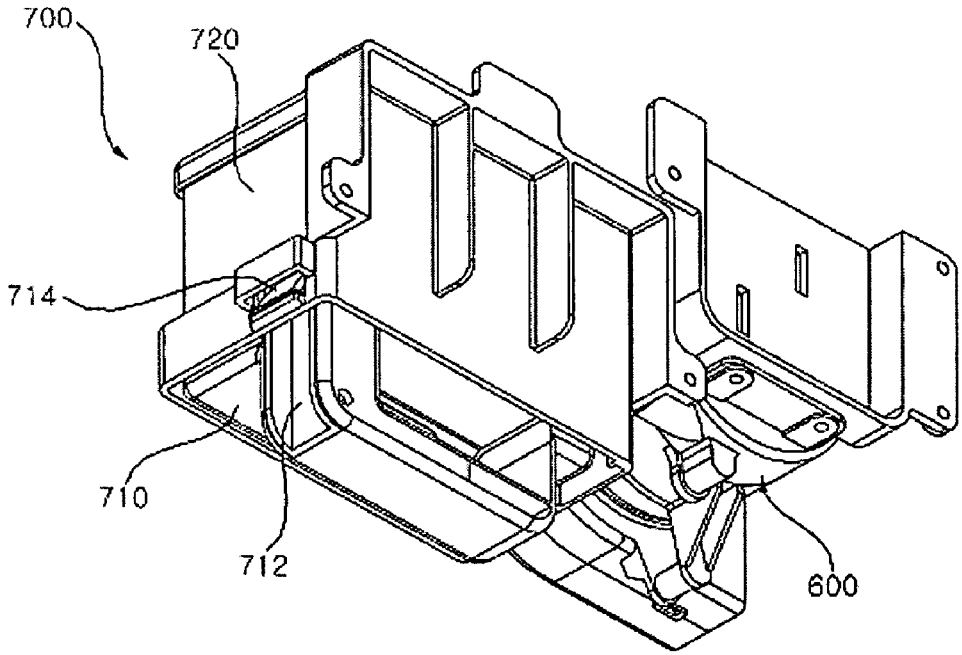
FIGS. 6 and 7 are a perspective view and a side view respectively illustrating a suctioning unit for suctioning foreign matter and a foreign matter collecting unit for collecting the foreign matter.
Figure 7:
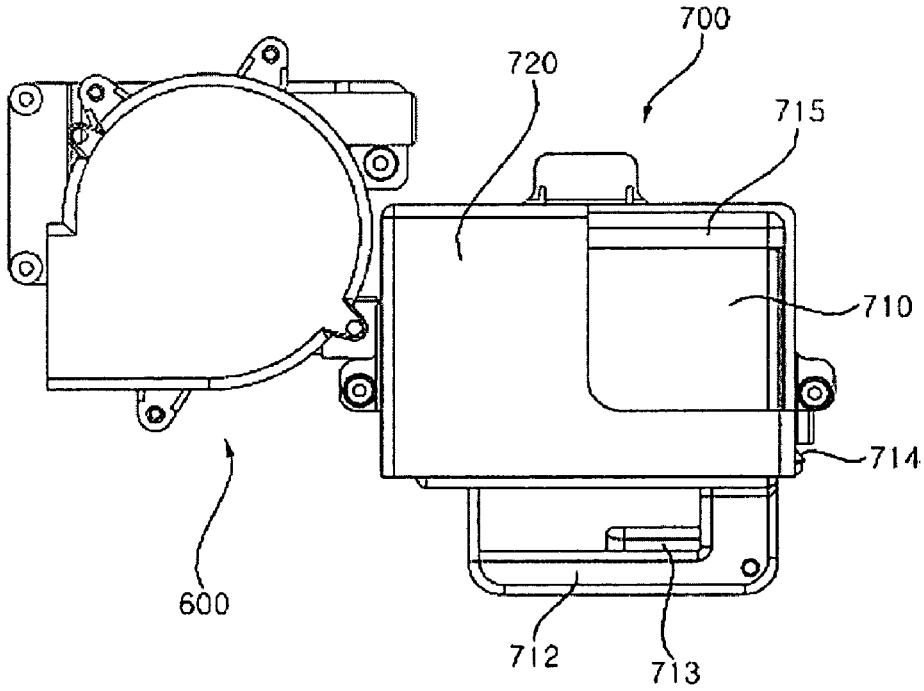
Figure 8:
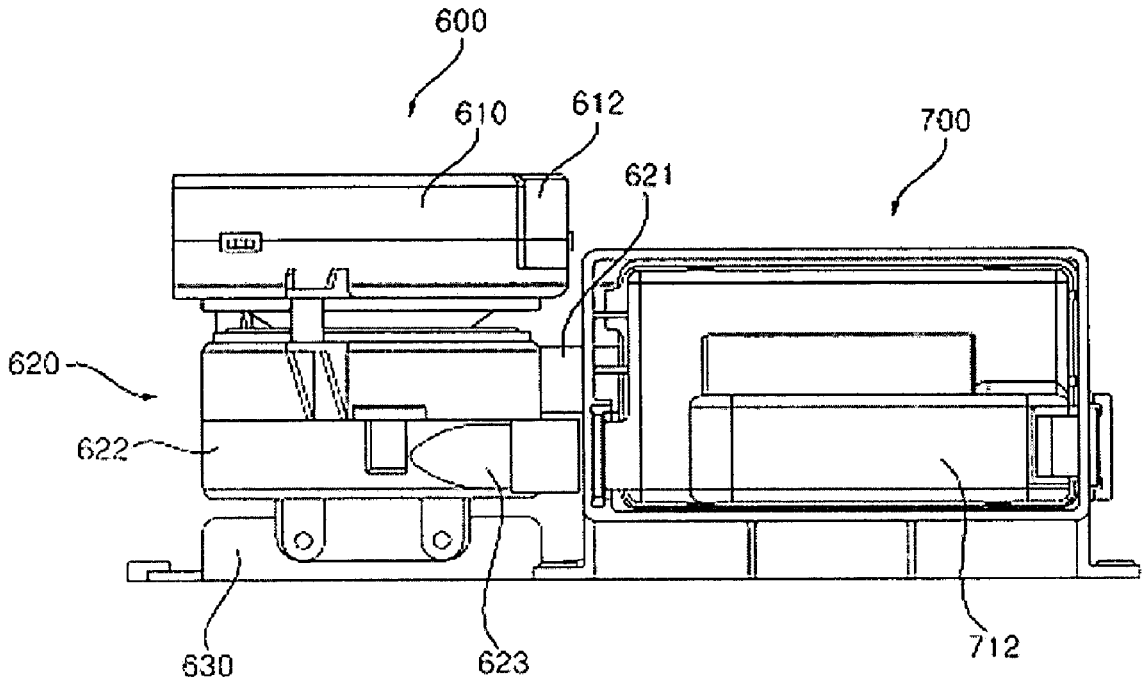
FIG. 8 is a bottom view illustrating assemblies of the suctioning unit and the foreign matter collecting unit.

FIGS. 6 and 7 are a perspective view and a side view respectively illustrating a suctioning unit 600 for suctioning foreign matter and a foreign matter collector 700 for collecting the foreign matter. FIG. 8 is a bottom view illustrating assemblies of the suctioning unit 600 and the foreign matter collector 700.

The foreign matter separated from the filter 380 and moved to a side of the filter housing 400 by the brush assembly 500 is suctioned and collected into the foreign matter collector 700 by the brush assembly 500 and the suctioning unit 600.

The suctioning unit 600 is disposed at one of outer sides of the case 200. The suctioning unit 600, when the brush assembly 500 moves to an end of the filter housing 400, communicates with the inside of the brush assembly 500 and suctions the accumulated foreign matter. The suctioning unit 600 includes a suction force generating unit 610 fro generating a suction force required to suction the foreign matter collected in the brush assembly 500, and a foreign matter collecting unit 620 through which the foreign matter is suction from the brush assembly 500 due to the suction force generated by the suction force generating unit 610.

The suction force generating unit 610 includes a blower 611 for generating the suction force when rotating and at least one discharge hole 612 through which air from which the foreign matter is filtered by the foreign matter collecting unit 620 is discharged. Moreover, the foreign matter collecting unit 620 may be a cyclone for separating air and foreign matter, suctioned by the suction force generating unit 610, from each other while the air and foreign matter spirally flow due to the centrifugal force.

Referring to FIG. 8, the cyclone 620 includes a dust suctioning hole 621, a dust discharging hole 623, and a dust collector main body 622.

The dust suctioning hole 621 becomes a passage through which the foreign matter is suctioned from the brush assembly 500, is not limited to a single dust suctioning hole 621 in FIG. 8, but may be plural according to the number of the passage through which foreign matter flows from the brush assembly 500.

The foreign matter and air suctioned through the dust suctioning hole 621 are stored in the dust collector main body 622. The foreign matter and air suctioned into the dust collector main body 622 spirally are separated from each while spirally flowing by the centrifugal force caused by the suctioning force generated by the suction force generating unit 610 and the foreign matter is discharged into the foreign matter collector 700. Therefore, the foreign matter firstly collected by the brush assembly 500 may be secondly collected into the foreign matter collector 700.

Referring to FIGS. 6 and 7, the suctioning unit 600, although not depicted, is disposed to communicate with a side of the brush assembly 500, and performs a function of providing a predetermined suctioning pressure to the brush assembly 500 to suction the foreign matter and to separate only suctioning foreign matter such that the foreign matter is secondly collected in the foreign matter collector 700. The suctioning unit 600 and the foreign matter collector 700 communicated with each other through the dust discharging hole 623 such that the foreign matter can be collected.

Meanwhile, the foreign matter collector 700 is disposed outside of the case 200, and is shielded from or exposed to the outside by the attachment and detachment of the side panel 350. Since the foreign matter collector 700 is exposed to the outside when the side panel 350 is detached, the user is able to detach the foreign matter collector 700 from the air conditioner 1 by simply detaching only the side panel 350, it is convenient to use.

The foreign matter collector 700 includes a dust container 710 in which the foreign matter separated from the filter 380 by the brush assembly 500 flows and is collected, and a dust container housing 720 fixed to an outer side of the case 200, attached with the dust container 710, and exposed when the user detaches the side panel 350.

Figure 9:
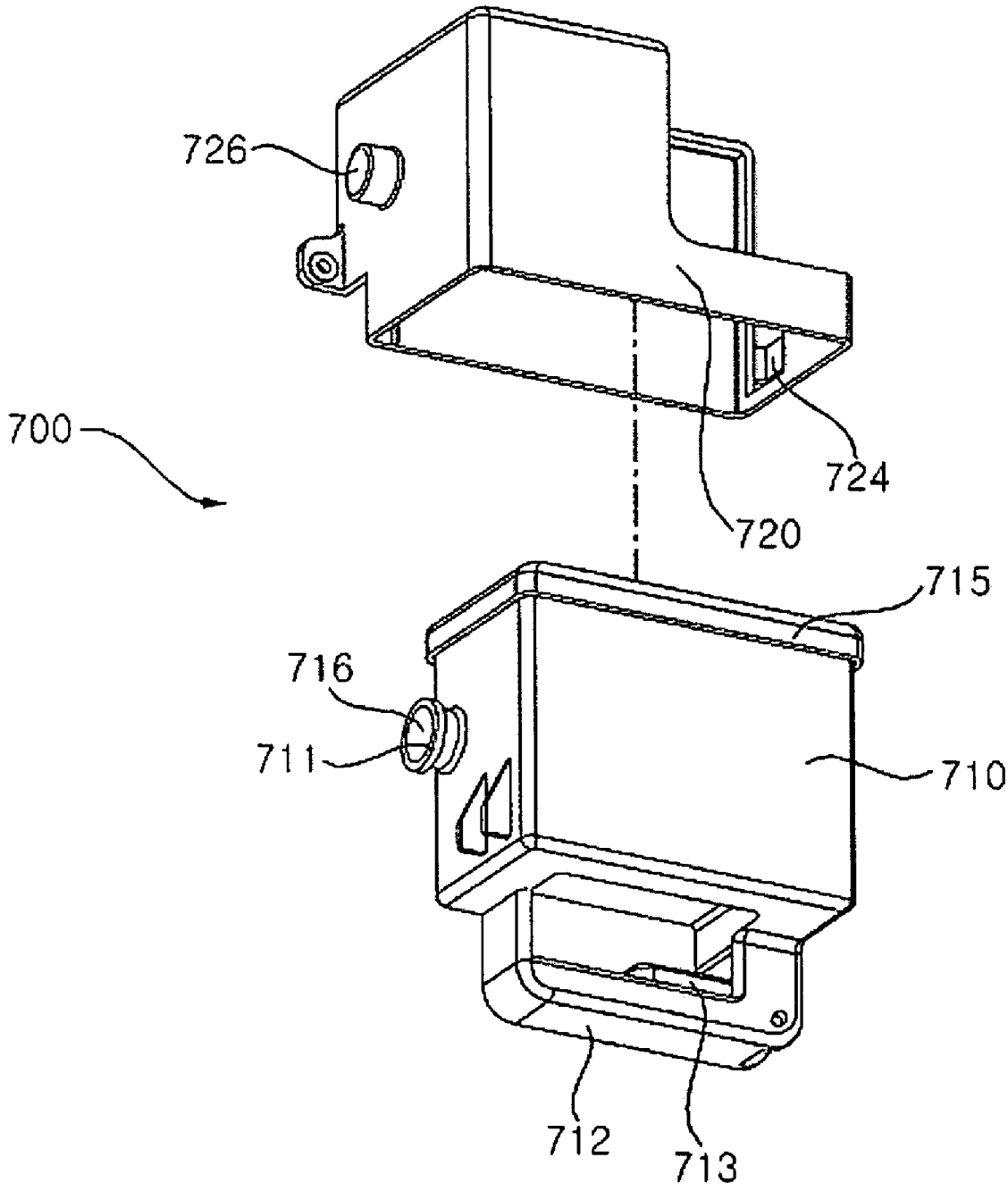
FIG. 9 is an exploded perspective view illustrating the foreign matter collecting unit of the ceiling type air conditioner according to an embodiment of the present invention, depicted in FIGS. 6 and 7.

FIG. 9 is an exploded perspective view illustrating the foreign matter collector 700 of the ceiling type air conditioner 1 according to the embodiment of the present invention, depicted in FIGS. 6 and 7. Referring to FIG. 9, the dust container housing 720 has an opened lower side such that the dust container 710 moves at the lower side in an inner linear direction of the dust container housing 720 or in a lower linear direction in the dust container housing 720 to be detached.

the dust container 710 may slide from the lower side of the dust container housing 720 to the very upper side (that is, in the vertical direction) to be coupled with the dust container housing 720, or may slide from the inside of the dust container housing 720 to the very lower side (that is, in the vertical direction) to be detached from the dust container housing 720.

Figure 10A:
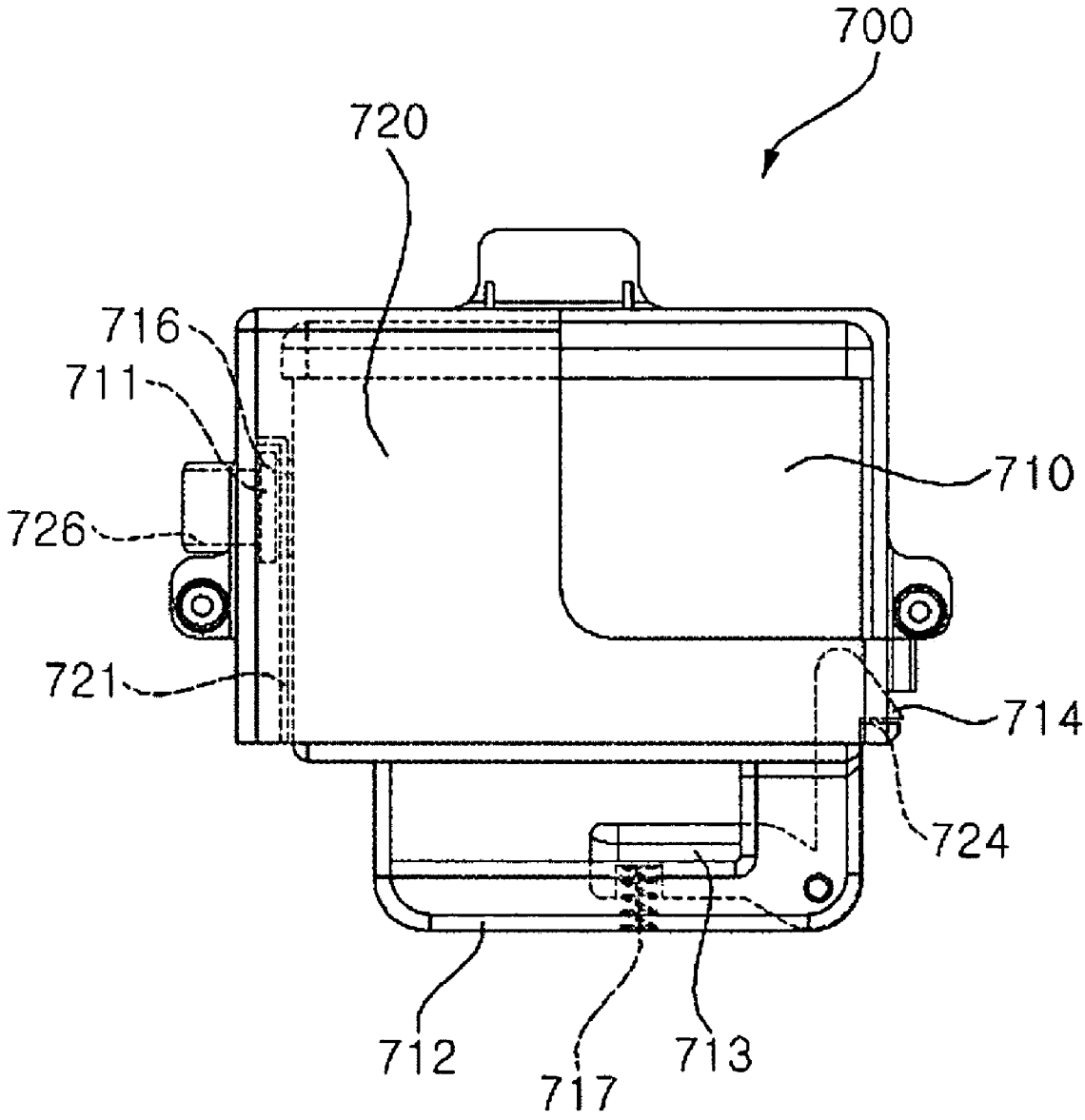
FIGS. 10A and 10B are side views illustrating a dust container of the foreign matter collecting unit of FIGS. 6 and 7 which is attached to and detached from a dust container housing.
Figure 10B:
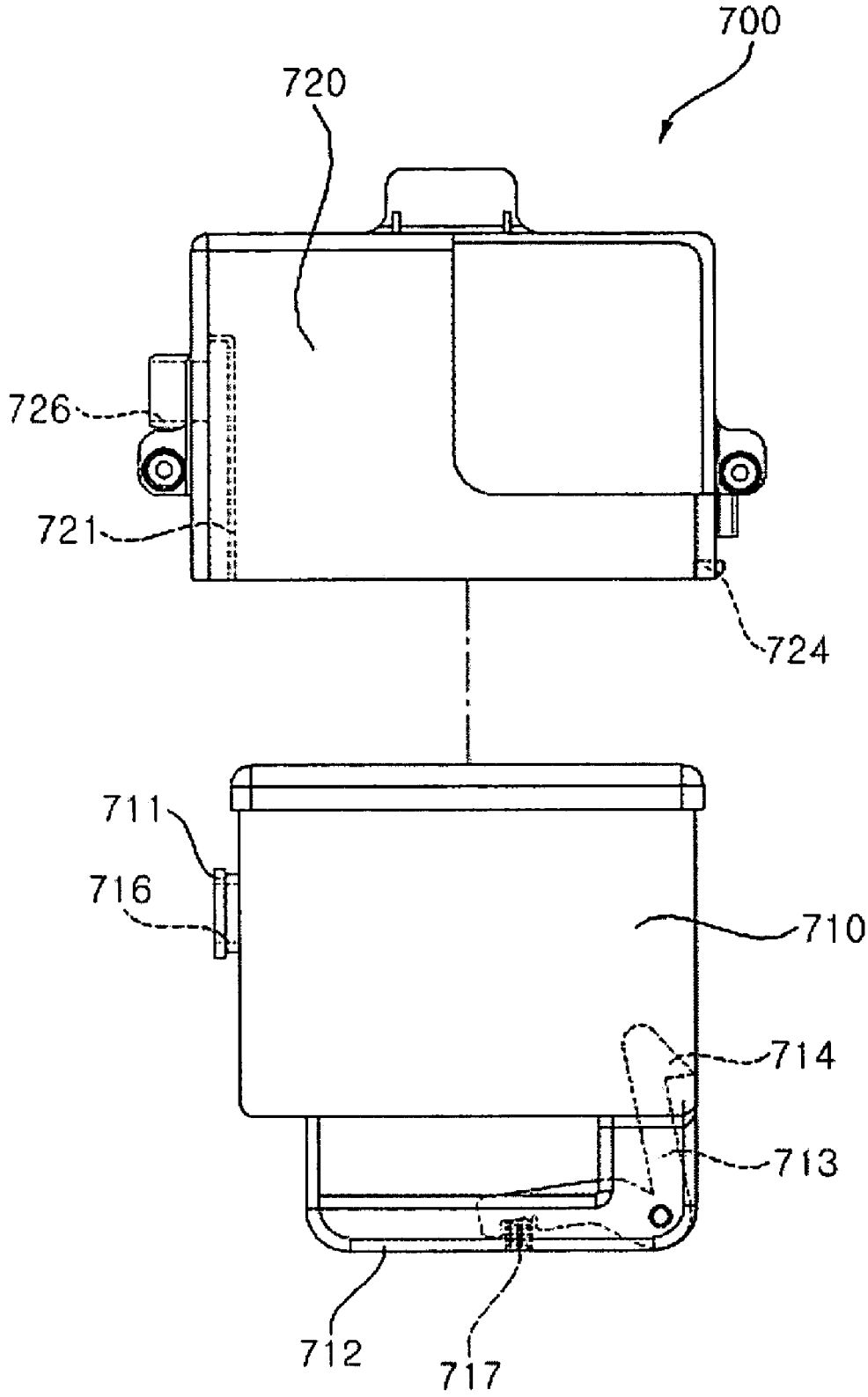

FIGS. 10A and 10B are side views illustrating the dust container 710 of the foreign matter collector 700 of FIGS. 6 and 7 which is attached to and detached from the dust container housing 720. Referring to FIGS. 10A and 10B, on an outer side of the dust container 710 at least one protrusion 711 protrudes toward the inner surface of the dust container housing 720. On the inner surface of the dust container housing 720, a guide recess 721 is formed long in the up-to-down direction to guide the at least one protrusion 711 to be inserted in the longitudinal direction and to move.

The protrusion 711 is formed with a first penetrating hole 716 for communicating the inside with the outside of the dust container 710. Meanwhile, a second penetrating hole 726 having a size corresponding to that of the first penetrating hole 716 is formed at a portion of the dust container housing 720 corresponding to the first penetrating hole 716 when the dust container 710 is coupled with the dust container housing 720. When the dust container 710 is inserted into and coupled with the dust container housing 720, the first penetrating hole 716 and the second penetrating hole 726 are aligned with each other and communicate with the suctioning unit 600 to form a single communicating hole for communicating the suctioning unit 600 with the foreign matter collector 700. The foreign matter, suctioned through the first penetrating hole 716 and the second penetrating hole 726 and separated by the suctioning unit 600, flows into and is accumulated in the dust container 710.

When the dust container 710 is coupled with the dust container housing 720, the protrusion 711 closely contacts the inner surface of the dust container housing 720 to seal the alignment between the first penetrating hole 716 and the second penetrating hole 726. However, the sealing between the first penetrating hole 716 and the second penetrating hole 726 is not limited to the protrusion 711. In other words, a sealing member (not shown) may be disposed between the first penetrating hole 716 and the second penetrating hole 726 to prevent the foreign matter flowing from the suctioning unit 600 from leaking out.

Meanwhile, the dust container 710 includes a grip 712 protruding to the lower side of the dust container housing 720 when the dust container 710 is coupled with the dust container housing 720. The grip 712 is a part grasped with a hand such that the user easily carries out the attachment and detachment of the dust container.

Moreover, the dust container 710 includes an attachment 713 disposed to the grip 712 and to attach or detach the dust container 710 to or from the dust container housing 720. In the attachment 713, an end 714A is disposed at the grip 712 corresponding to the part grasped by the user and the other end 714B extends to the dust container housing 720 by a predetermined length. An intermediate portion of the attachment 713 is fixed to a side of the grip 712 by a hinge 717 and is spaced away from the dust container housing 720 or contacts the inner surface of the dust container housing 720 while the other end 714B rotates about the hinge 717 toward a side or the other side when the end 714A rotates about the hinge 717 to a side or the other side due to an external force.

In the dust container housing 720 where the other end 714B of the attachment 713 is positioned when the dust container 710 is coupled with the dust container housing 720 such that the dust container 710 and the dust container housing 720 are easily coupled with and are separated from each other, a locking hole 724 is formed to communicate the inside with the outside of the dust container housing 720 such that the other end 714B of the attachment 713 is locked or released. The locking hole 724 couples and releases the dust container 710 with and from the dust container housing 720 by being locked by and released from the other end 714B of the attachment 713. The configuration of locking the other end 714B of the attachment 713 to the dust container housing 720 and of releasing the locked state of the other end 714B is not limited to the locking hole 724 penetrating the inside and the outside of the dust container housing 720. In other words, if the other end 714B of the attachment 713 is able to contact the dust container housing 720 or to be released from the dust container housing 720 due to an external force to couple or release the dust container 710 with or from the dust container housing 720, a locking recess may be formed to lock the other end 714B of the attachment 713.

A status when the other end 714B of the attachment 713 is spaced apart from the dust container housing 720 and thus is separated from the locking hole 724 is that the coupling between the dust container 710 and the dust container housing 720 is released, and a status when the other end 714B of the attachment 713 contacts the inner surface of the dust container housing 720 and is locked in the locking hole 724 is that the dust container 710 is coupled with the dust container housing 720.

The attachment 713 includes an elastic member 717 disposed between the attachment 713 and the grip 712 to provide a predetermined elastic force such that the other end 714B of the attachment 713 contacts the inner surface of the dust container housing 720. The elastic member 717 may be a spring having an end contacting the grip 712 to be supported and the other end contacting the attachment 713 to be supported. When the user grasps the grip 712 and the end 714A of the attachment 713 at the same time, or when the other end 714B of the attachment 713 contacts the inner surface of the dust container housing 720 such that an external force is transmitted to the attachment 713 during the movement of the dust container 710 into the dust container housing 720 for the coupling, the elastic member 717 is elastically deformed (for example, a compression deformation) and provides a predetermined elastic force to the end 714A of the attachment 713. In this state, if the external force provided to the attachment 713 is removed when the dust container 710 moves into the dust container housing 720 and thus the other end 714B of the attachment 713 reaches the locking hole 724, the elastic member 717 returns to its initial state and rotates the end 714A of the attachment 713 to a side, and at this time the other end 714B of the attachment 713 is locked in the locking recess so that the dust container 710 is coupled with the dust container housing 720.

As described above, in the ceiling type air conditioner 1 according to the embodiment of the present invention, since the user simply operates the attachment 713 to attach and detach the dust container 710 to and from the dust container housing 720, convenience is enhanced.

Meanwhile, the foreign matter collector 700 further includes a dust container lid 715 coupled with the dust container 710. The dust container lid 715 is detachably coupled with the dust container 710 and the coupling of the dust container lid 715 may be various ways such as a rotary manner in which an end is fixed by a hinge (not shown), a separation type in which the whole dust container lid 715 is separated from the dust container 710, and the like. When the dust container 710 is full with the foreign matter, the user detaches the dust container 710 from the dust container housing 720 and separates the dust container lid 715 from the dust container 710 to discharge the foreign matter out. In this case, the dust container lid 715 prevents the foreign matter from pouring down from the dust container 710 when the dust container 710 is excessively shaken due to the careless detachment of the dust container 710 from the dust container housing 720 by the user.

Figure 11:
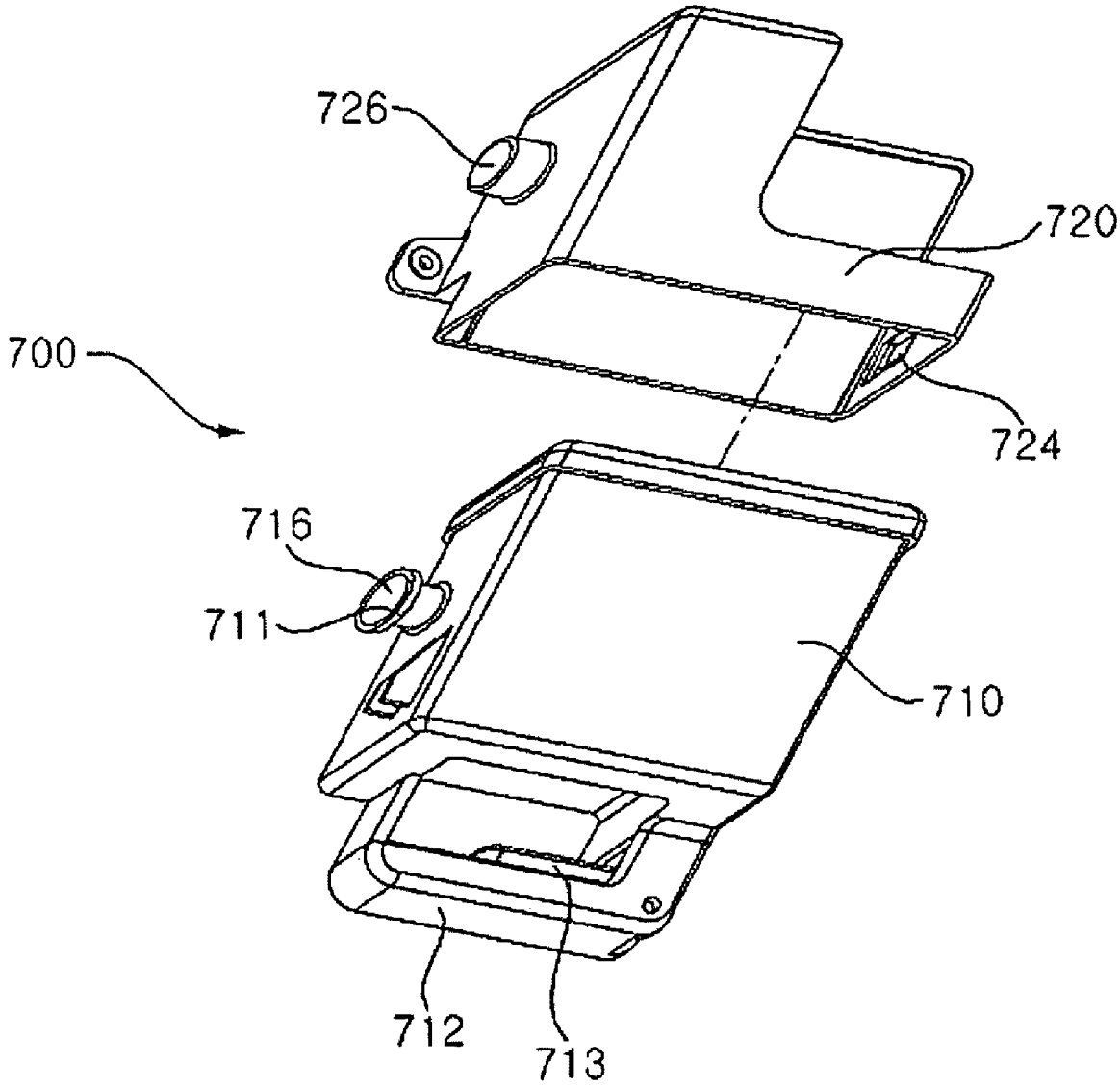
FIG. 11 is an exploded perspective view illustrating a foreign matter collecting unit according to another embodiment of the present invention.

FIG. 11 is an exploded perspective view illustrating a foreign matter collector 700' according to another embodiment of the present invention. Same reference numerals are assigned to the same components as those of the above-mentioned embodiment. Referring to FIG. 11, the foreign matter collector 700' includes a dust container housing 720 leaning to an oblique direction against an approximately vertical direction, and a dust container 710 leaning to an oblique direction against an approximately vertical direction, like the dust container housing 720 to be attached to and detached from the dust container housing 720.

The foreign matter collector 700', different from the foreign matter collector 700, as described above, that slides from the lower side of the dust container housing 720 in the vertical direction to be coupled with the dust container housing 720 or that slides from the inside of the dust container housing 720 in the vertical direction to be detached from the dust container housing 720, is attached to or detached from the dust container housing 720 by which the dust container 710 obliquely slides. In the foreign matter collector 700', since it is enough for the user to look his/her head up or to lift a hand slightly to attach and detach the dust container 710 to and from the dust container housing 720 in comparison to the foreign matter collector 700 according to the first embodiment of the present invention, the convenience can be enhanced.

Operation of the ceiling type air conditioner 1 according to the embodiment of the present invention will be described as follows.

Firstly, the moving unit 640 reciprocates the brush assembly 500 linearly to clean the filter 380 so as to firstly collect foreign matter in the brush assembly 500. When the reciprocating times of the brush assembly 500 higher than predetermined times or when a predetermined operating time of the brush assembly 500 has elapsed, in order to secondly collect the foreign matter accumulated in the main body 510 of the brush assembly 500 into the foreign matter collector 700, the moving unit 640 moves the brush assembly 500 to a position through which the foreign matter of the brush assembly 500 is discharged out.

When the brush assembly 500 communicates with the suctioning unit 600, the foreign matter is secondarily collected into the foreign matter collector 700 via the brush assembly 500 and the foreign matter collecting unit 620 due to the operation of the suction force generating unit 610.

When the foreign matter collector 700 is filled with foreign matter for a long use, the user detaches only the side panel 350 from the base panel 300. At that time, the foreign matter collector 700 is exposed so that the user can easily detach the foreign matter collector 700 without separating other components such as whole base panel 300 from the air conditioner 1.

Next, the user manipulates the attachment 713 by grasping the grip 712 of the dust container 710 among the components of the foreign matter collector to release the coupling between the dust container 710 and the dust container housing 720. At that time, when the user moves the grip down, the dust container 710 is detached from the dust container housing 720.

Finally, the user discharges the foreign full in the dust container 710 and couples the dust container 710 with the dust container housing 720 in the order reverse to the above-mentioned detachment of the dust container 710 and couples the side panel 350 to the base panel 300.

As such, according to the ceiling type air conditioner 1 of the present invention, since the side panel 350 only is separated from the base panel 300 and the dust container 710 can be attached to and detached from, the convenience is remarkably enhanced.

Although the equipment controlling system and a controlling method thereof according to the present invention have been described with reference to the embodiment shown in the drawings, these are merely illustrative, and those skilled in the art will understand that various modifications and equivalent other embodiments of the present invention are possible. Consequently, the true technical protective scope of the present invention must be determined based on the technical spirit of the appended claims.

What is claimed is:

1. A ceiling type air conditioner comprising:

a case disposed on the ceiling and having a predetermined space defined therein;

a base panel disposed in the case and having an air intake hole formed at a side thereof;

a filter disposed at the air intake hole;

a filter housing on which the filter is seated:

a brush assembly for firstly collecting and accumulating foreign matter filtered by the filter;

a suctioning unit for suctioning the foreign matter collected in the brush assembly when the suctioning unit communicates with the brush assembly; and a foreign matter collector for secondarily collecting the foreign matter suctioned by the suctioning unit; and a moving unit for moving the brush assembly linearly to clean the filter so as to firstly collect foreign matter in the brush assembly and for moving the brush assembly linearly to a position where the brush assembly communicates with the suctioning unit, wherein the suctioning unit comprises:

a suction force generating unit for generating a suction force to suction the foreign matter collected in the brush assembly; and a foreign matter collecting unit through which the foreign matter is suctioned from the brush assembly due to the suction force generated by the suction force generating unit when the suctioning unit communicates with the brush assembly.

2. The ceiling type air conditioner of claim 1, wherein the brush assembly further comprises:

a brush that contacts foreign matters filtered by the filter;

a main body that contacts the brush to form a predetermined space in which the foreign matters that drop from the filter are collected and stored; and a plurality of rollers disposed between the filter housing and the main body.

3. The ceiling type air conditioner of claim 2, wherein the filter housing comprises a movement guiding unit formed at one side thereof to support sides of the main body so as to guide the movement of the brush assembly and to prevent the main body from being detached, and the plurality of rollers are disposed in the movement guiding unit to roll.

4. The ceiling type air conditioner of claim 1, wherein the moving unit reciprocates the brush assembly linearly along a side of the filter.

5. The ceiling type air conditioner of claim 4, wherein the moving unit comprises:

a driving motor disposed in at least one side of the filter housing; and a power transmission connected to the brush assembly to transmit a driving force of the driving motor to the brush assembly.

6. The ceiling type air conditioner of claim 1, further comprising a side panel detachably attached to the lower side of the base panel corresponding to one of right and left sides of the base panel, wherein, when the side panel is detached from the base panel, the foreign matter collector is exposed to the outside.

7. The ceiling type air conditioner of claim 1, wherein the foreign matter collector comprises:

a dust container for collecting the foreign matter due to the suction force; and a dust container housing fixed to the outside of the case and detachably attached to the dust container.

8. The ceiling type air conditioner of claim 7, wherein the foreign matter collector further comprises a dust container lid coupled with the dust container.

9. The ceiling type air conditioner of claim 7, wherein the dust container slides in a linear direction in the lower side of the dust container housing to be coupled with the inside of the dust container housing, and slides from the inside of the dust container housing in a linear direction to be detached from the dust container housing.

10. The ceiling type air conditioner of claim 9, wherein the linear direction comprises a vertical direction and an oblique direction.

11. The ceiling type air conditioner of claim 7, wherein, on the outside surface of the dust container, at least one protrusion protrudes toward the inner surface of the dust container housing, and on the inner surface of the dust container housing a guide recess for guiding the at least one protrusion to be inserted and moved in the linear direction.

12. The ceiling type air conditioner of claim 11, wherein the protrusion is formed with a first penetrating hole to communicate the inside with the outside of the dust container, and the dust container housing comprises a second penetrating hole for communicating the inside with the outside of the dust container housing, and the first penetrating hole and the second penetrating hole are aligned with each other and communicate with the suctioning unit when the dust container is coupled with the dust container housing.

13. The ceiling type air conditioner of claim 12, further comprising a sealing member disposed between the first penetrating hole and the second penetrating hole for preventing the foreign matter flowing from the suctioning unit from leaking out.

14. The ceiling type air conditioner of claim 7, wherein the dust container comprises:

a grip protruding to the lower side of the dust container housing when the dust container is coupled with the dust container housing; and an attachment disposed in the grip to couple the dust container to the dust container housing and to release the coupling between the dust container and the dust container housing.

15. The ceiling type air conditioner of claim 14, wherein the attachment comprises an intermediate portion fixed to a side of the grip by a hinge such that, when an end and the other end rotate about the hinge in the same direction by an external force, the other end contacts the dust container housing and is away from the dust container housing to couple the dust container to the dust container housing and release the dust container from the dust container housing.

16. The ceiling type air conditioner of claim 14, wherein the dust container housing is formed with a locking recess for coupling and releasing the dust container to and from the dust container housing while the other end of the attachment is locked by and released from the locking recess when the other end of the attachment contacts and is spaced away from the dust container housing.

17. The ceiling type air conditioner of claim 14, further comprising an elastic member disposed between the grip and the attachment to provide an elastic force of bringing the other end of the attachment into contact with the dust container housing.

18. The ceiling type air conditioner of claim 1, wherein the foreign matter collecting unit is a cyclone for separating air and the foreign matter, suctioned by the suction force generating unit, from each other while the air and foreign matter spirally flow due to the centrifugal force, wherein the cyclone comprises a dust suctioning hole that becomes a passage through which the foreign matter is suctioned from the brush assembly;

a dust collector main body for separating the foreign matter and air suctioned through the dust suctioning hole by the centrifugal force caused by the suctioning force generated by the suction force generating unit; and a dust discharging hole for discharging the foreign matter in the dust collector main body into the foreign matter collector.

19. The ceiling type air conditioner of claim 1, wherein the suction force generating unit is operated when the brush assembly communicates with the foreign matter collecting unit.

20. The ceiling type air conditioner of claim 19, wherein the brush assembly communicates with the foreign matter collecting unit, when the brush assembly moves to an end of the filter housing.

* * * * *